US006972770B1

(12) United States Patent
Cohen et al.

(10) Patent No.: US 6,972,770 B1
(45) Date of Patent: Dec. 6, 2005

(54) METHOD AND APPARATUS FOR PERFORMING RASTER OPERATIONS IN A DATA PROCESSING SYSTEM

(75) Inventors: Marc Leslie Cohen, Austin, TX (US); Scott Thomas Jones, Austin, TX (US); Ravi Ravisankar, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 593 days.

(21) Appl. No.: 09/377,642

(22) Filed: Aug. 19, 1999

(51) Int. Cl.[7] ..... G09G 5/37
(52) U.S. Cl. ..... 345/562; 345/561
(58) Field of Search ..... 345/561–563, 345/507, 530, 545, 522, 537, 538; 710/1, 710/5, 52, 33; 709/100, 101

(56) References Cited

U.S. PATENT DOCUMENTS

| | | | | |
|---|---|---|---|---|
| 4,811,281 A | | 3/1989 | Okamoto et al. | 364/900 |
| 4,969,092 A | | 11/1990 | Shorter | 364/200 |
| 5,115,392 A | | 5/1992 | Takamoto et al. | 395/650 |
| 5,161,223 A | | 11/1992 | Abraham | 395/600 |
| 5,283,883 A | | 2/1994 | Mishler | 395/425 |
| 5,473,566 A | * | 12/1995 | Rao | 345/537 |
| 5,631,694 A | | 5/1997 | Aggarwal et al. | 348/7 |
| 5,699,498 A | * | 12/1997 | Noorbakhsh | 345/591 |
| 5,706,483 A | * | 1/1998 | Patrick et al. | 345/562 |
| 5,790,887 A | | 8/1998 | Brech | 395/825 |
| 5,805,821 A | | 9/1998 | Saxena et al. | 395/200.61 |
| 5,861,893 A | * | 1/1999 | Sturgess | 345/522 |
| 5,982,991 A | * | 11/1999 | Smith | 358/1.15 |

* cited by examiner

*Primary Examiner*—Kee M. Tung
(74) *Attorney, Agent, or Firm*—Duke W. Yee; Jeffrey S. LaBaw; Stephen R. Tkacs

(57) ABSTRACT

A method and apparatus in a data processing system for performing a raster operation of graphics data. A system memory and a video memory is included in the data processing system. The system memory and the video memory are connected by a bus wherein the graphics data is organized into picture elements. A plurality of picture elements is read from the system memory. A plurality of picture elements is read from the video memory. A raster operation is performed on the plurality of picture elements to form a plurality of processed picture elements. The plurality of processed picture elements is written to the video memory.

20 Claims, 4 Drawing Sheets

Figure 1
AT9-99-287
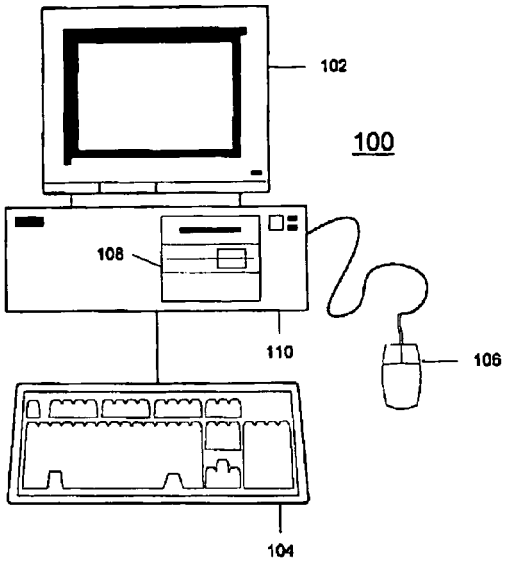
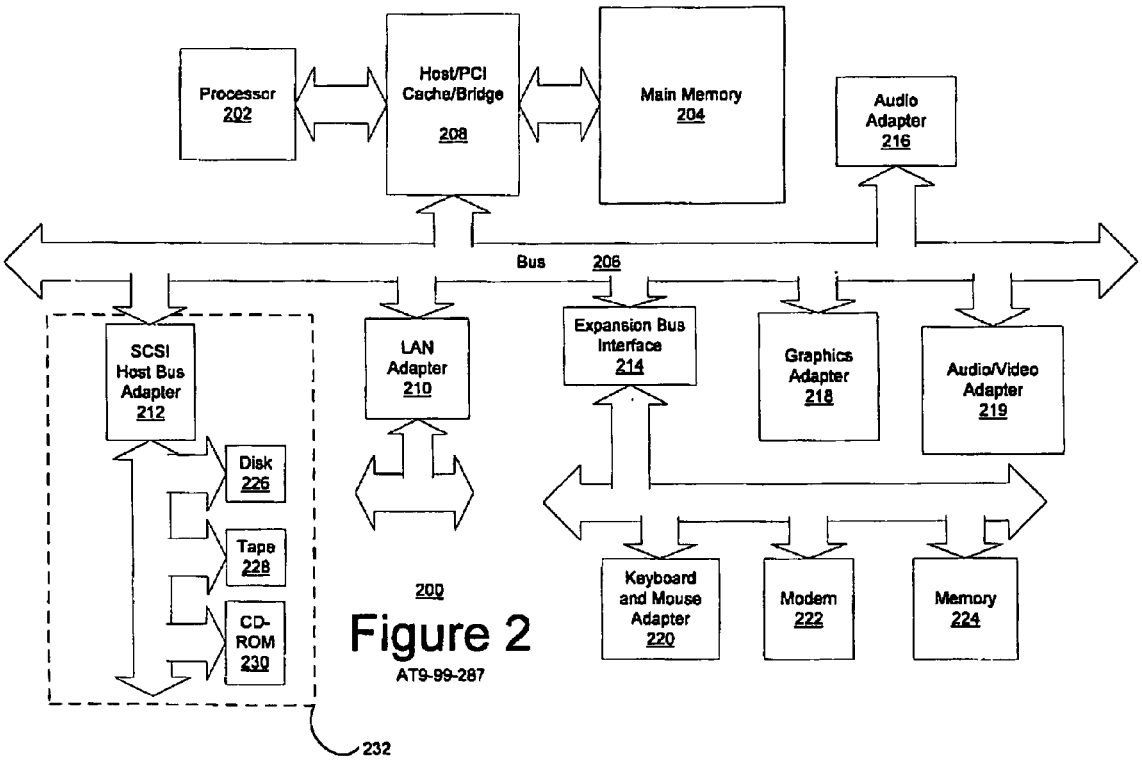
Figure 2
AT9-99-287

Figure 4

AT9-99-287

400

| Logical Function | Hex Code | Definition |
|---|---|---|
| clear | 0x0 | 0 |
| and | 0x1 | src AND dst |
| andReverse | 0x2 | src AND (NOT dst) |
| copy | 0x3 | src |
| andInverted | 0x4 | (NOT src) AND dst |
| noop | 0x5 | dst |
| xor | 0x6 | src XOR dst |
| or | 0x7 | src OR dst |
| nor | 0x8 | (NOT src) AND (NOT dst) |
| equiv | 0x9 | (NOT src) XOR dst |
| invert | 0xa | (NOT dst) |
| orReverse | 0xb | src OR (NOT dst) |
| copyInverted | 0xc | (NOT src) |
| orInverted | 0xd | (NOT src) OR dst |
| nand | 0xe | (NOT src) OR (NOT) dst) |
| set | 0xf | 1 |

AT9-99-287
Prior Art

METHOD AND APPARATUS FOR PERFORMING RASTER OPERATIONS IN A DATA PROCESSING SYSTEM

BACKGROUND OF THE INVENTION

1. Technical Field

The present invention relates generally to an improved data processing system and, in particular, to an improved method and apparatus for processing graphics data. Still more particularly, the present invention relates to a method and apparatus for performing raster operations in a data processing system.

2. Description of Related Art

As the monitors connected to computers become larger and faster the performance of the graphics subsystem must also be improved. It is not uncommon on PCs to find 19, 20 or 21 inch monitors capable of displaying images with 1200×1600 resolution (that is, 1200 scan lines vertically by 1600 picture elements, or pels, horizontally for each scan line) with refresh rates up to 85 Hz. The bitmap images manipulated by the processor are stored in main memory and must be transferred to the video memory on the graphics controller board. This transfer must be made as fast as possible.

At the heart of every graphical programming interface (GPI) is the concept of a raster operation (ROP). These raster operations are typically defined using 256 different combinations of logical operations performed on the source, pattern, and destination images to produce a new destination image. These operations are usually performed one picture element (pel) at a time. Previously, performance problems have been identified with accessing video memory. Previous solutions have focused on reducing the number of instructions used to perform various graphic operations. These and other prior solutions, however, do not recognize problems associated with data transfer across a bus. Performance problems associated with changing the direction of data transfer in raster operations have been previously unrecognized. The present invention has recognized that when both source and destination images involved in the raster operation exist in video memory, severe performance problems can be experienced due to the overhead of repeatedly switching the input/output (I/O) bus from input to output and back. Therefore, it would be advantageous to have an improved method and apparatus for performing raster operations.

SUMMARY OF THE INVENTION

The present invention provides a method and apparatus in a data processing system for performing a raster operation of graphics data. A system memory and a video memory is included in the data processing system. The system memory and the video memory are connected by a bus wherein the graphics data is organized into picture elements. A plurality of picture elements is read from the system memory. A plurality of picture elements is read from the video memory. A raster operation is performed on the plurality of picture elements to form a plurality of processed picture elements. The plurality of processed picture elements is written to the video memory.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 1 is a pictorial representation depicting a data processing system in which the present invention may be implemented in accordance with a preferred embodiment of the present invention;

FIG. 2 is a block diagram illustrating a data processing system in which the present invention may be implemented;

FIG. 4 is a diagram illustrating common raster operations depicted in accordance with a preferred embodiment of the present invention;

DETAILED DESCRIPTION OF THE PREFERRED EMBODIMENT

Figure 3:
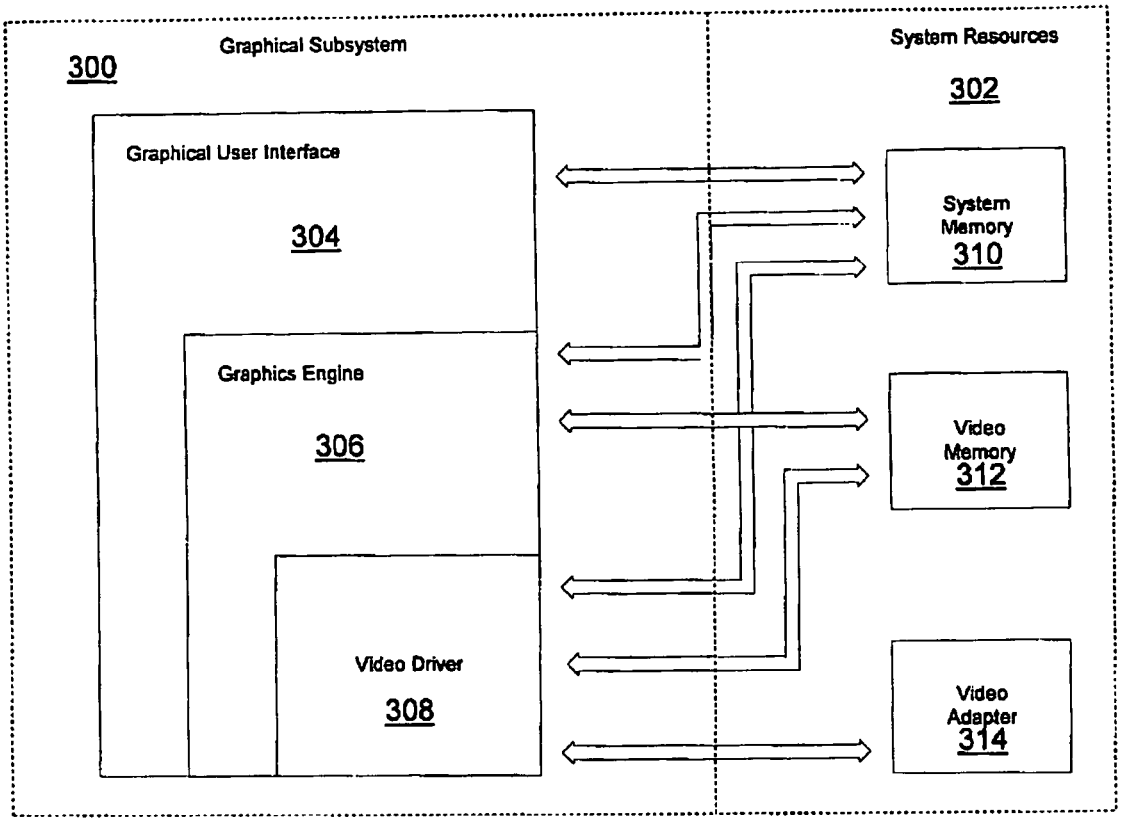
FIG. 3 is a block diagram illustrating graphical subsystem layers and system resources used in processing raster operations depicted in accordance with a preferred embodiment of the present invention.

With reference now to the figures and in particular with reference to FIG. 1, a pictorial representation depicting a data processing system in which the present invention may be implemented in accordance with a preferred embodiment of the present invention. A personal computer 100 is depicted which includes a system unit 110, a video display terminal 102, a keyboard 104, storage devices 108, which may include floppy drives and other types of permanent and removable storage media, and mouse 106. Additional input devices may be included with personal computer 100. Personal computer 100 can be implemented using any suitable computer, such as an IBM Aptiva™ computer, a product of International Business Machines Corporation, located in Armonk, N.Y. Although the depicted representation shows a personal computer, other embodiment of the present invention may be implemented in other types of data processing systems, such as network computers, Web based television set top boxes, Internet appliances, etc. Computer 100 also preferably includes a graphical user interface that may be implemented by means of systems software residing in computer readable media in operation within computer 100.

With reference now to FIG. 2, a block diagram illustrates a data processing system in which the present invention may be implemented. Data processing system 200 is an example of a computer, such as computer 100 in FIG. 1, in which code or instructions implementing the processes of the present invention may be located. Data processing system 200 employs a peripheral component interconnect (PCI) local bus architecture. Although the depicted example employs a PCI bus, other bus architectures such as Micro Channel and Industry Standard Architecture (ISA) may be used. Processor 202 and main memory 204 are connected to PCI local bus 206 through PCI bridge 208. PCI bridge 208 also may include an integrated memory controller and cache memory for processor 202.

Additional connections to PCI local bus 206 may be made through direct component interconnection or through add-in boards. In the depicted example, local area network (LAN) adapter 210, small computer system interface SCSI host bus adapter 212, and expansion bus interface 214 are connected to PCI local bus 206 by direct component connection. In contrast, audio adapter 216, graphics adapter 218, and audio/video adapter 219 are connected to PCI local bus 206 by add-in boards inserted into expansion slots. Expansion bus interface 214 provides a connection for a keyboard and mouse adapter 220, modem 222, and additional memory 224. SCSI host bus adapter 212 provides a connection for hard disk drive 226, tape drive 228, and CD-ROM drive 230. Typical PCI local bus implementations will support three or four PCI expansion slots or add-in connectors.

An operating system runs on processor 202 and is used to coordinate and provide control of various components within data processing system 200 in FIG. 2. The operating system may be a commercially available operating system such as OS/2, which is available from International Business Machines Corporation. "OS/2" is a trademark of International Business Machines Corporation. An object oriented programming system such as Java may run in conjunction with the operating system and provides calls to the operating system from Java programs or applications executing on data processing system 200. "Java" is a trademark of Sun Microsystems, Inc. Instructions for the operating system, the object-oriented operating system, and applications or programs are located on storage devices, such as hard disk drive 226, and may be loaded into main memory 204 for execution by processor 202.

Those of ordinary skill in the art will appreciate that the hardware in FIG. 2 may vary depending on the implementation. Other internal hardware or peripheral devices, such as flash ROM (or equivalent nonvolatile memory) or optical disk drives and the like, may be used in addition to or in place of the hardware depicted in FIG. 2. Also, the processes of the present invention may be applied to a multiprocessor data processing system.

For example, data processing system 200, if optionally configured as a network computer, may not include SCSI host bus adapter 212, hard disk drive 226, tape drive 228, and CD-ROM 230, as noted by dotted line 232 in FIG. 2 denoting optional inclusion. In that case, the computer, to be properly called a client computer, must include some type of network communication interface, such as LAN adapter 210, modem 222, or the like. As another example, data processing system 200 may be a stand-alone system configured to be bootable without relying on some type of network communication interface, whether or not data processing system 200 comprises some type of network communication interface. As a further example, data processing system 200 may be a Personal Digital Assistant (PDA) device which is configured with ROM and/or flash ROM in order to provide non-volatile memory for storing operating system files and/or user-generated data.

The depicted example in FIG. 2 and above-described examples are not meant to imply architectural limitations. For example, data processing system 200 also may be a notebook computer or hand held computer in addition to taking the form of a PDA. Data processing system 200 also may be a kiosk or a Web appliance.

With reference now to FIG. 3, a block diagram illustrating graphical subsystem layers and system resources used in processing raster operations is depicted in accordance with a preferred embodiment of the present invention. In the depicted example, graphical subsystem 300 uses system resources 302 in performing raster operations. Graphical subsystem 300 contains a graphical user interface 304, a graphics engine 306, and a video driver 308. System resources 302 contains system memory 310, video memory 312, and video adapter 314.

Graphics engine 306 is a software subsystem layer within graphical subsystem 300, which provides common graphical functions, which may process graphics data or send instructions for creating graphics images to hardware via a video driver. Video driver 308 is software that provides an interface between video adapter 314 hardware and other programs, such as a graphics engine or an operating system. Video driver 308 provides adapter specific functions. If video driver 308 is unable to perform a function, video driver 308 will call graphics engine 306 to perform the function. In other words, graphics engine 306 performs common functions without regard to the particular hardware while video driver 308 performs specific functions. In these examples, system memory 310 may be implemented using main memory 204 in FIG. 2, while video memory 312 may be located within graphics adapter 218 in FIG. 2. Video adapter 314 also may be implemented using graphics adapter 218 in FIG. 2.

In this example, graphical user interface 304 is able to access system memory 310, but not video memory 312 or video adapter 314. Graphics engine 306 has an ability to access system memory 310 and video memory 312. Video driver 308 has the ability to access system memory 310, video memory 312, and video adapter 314. In particular, video driver 308 accesses a processor located on video adapter 314.

In previous systems, graphics engine 306 would obtain a pel from system memory 310 and a pel from video memory 312. This information is stored in a register and a logical OR function is performed on the pel with the result then being returned to video memory 312. As can be seen, a read and a write operation is required for each pel that is processed. This read and write operation for each pel results in the direction of data transfer on the bus to the video memory being changed twice for each pel that is processed. Such a repeated change in direction of data transfer results in performance degradation in graphics processing, which was previously unrecognized by the prior art. The present invention recognizes that performance degradation occurs with changing the direction of data transfer for each pel when performing graphics processing, such as raster operations.

To understand this problem, it is helpful to examine some particular cases. When raster operation is performed updating the video memory without regard to the current state of the video memory, then no performance problems occur. This situation is present because the I/O bus connecting the video memory to the system is always sending data in one direction. The raster operation "src->dst" is an example of a single direction data transfer. With this raster operation, each pel is read from the source bitmap (src) in system memory and written to the corresponding pel in the destination bitmap (dst) in video memory. The transfer of data is strictly unidirectional from the system memory to the video memory.

However, if the raster operation is "src OR dst->dst", each pel written to the destination bitmap in video memory is constructed by performing a logical OR operation on pels read from both the source bitmap in system memory and the destination bitmap in video memory. In existing systems, this operation is performed one pel at a time. This type of operation incurs a bus turnaround delay twice for every pel. In other words, the current value of the pel in the video memory must be sent to the processor (input direction) and ORed with the current value in system memory. This resultant value is then sent from the system memory to the video memory (output direction). A delay is involved every time the I/O bus has to change direction and this occurs twice per pel. In these circumstances, significant performance degradation is present.

The present invention solves this problem by providing a method, apparatus, and instructions for faster raster operations. The processes of the present invention may be applied to a raster, which is a regular pattern of lines. On a video display, the raster operations are performed in which the number of changes in the direction in which data transfer occurs is minimized. Raster operations are methods of generating graphics that treat an image as a collection of small independently controlled dots, such as pixels or picture elements, which may be arranged in rows and columns. This increased performance is provided by a mechanism in which a block of pels, such as, for example, a scan line, is read from video memory 312 into a buffer in system memory 310. Another scan line is placed into a buffer in system memory 310. At this time, a logical OR operation is performed. This operation may be a pel at the time with each pel being returned to video memory 312 as the logical OR operation is performed.

Alternatively, an entire block of information may be logically ORed prior to returning the information to video memory 312. This transfer of data may be made using, for example, a bit block transfer, which is a mechanism to manipulate blocks of bits and memory that represent color and other attributes of a rectangular block of pixels forming a screen image. In this manner, successive changes in the direction of data flow on the bus are not required for each pel. Instead, the change in direction may be made for a group of pels, such as a scan line.

In the depicted examples, the processes are illustrated as being located within graphics engine 306, since graphics accelerations would be controlled by the video driver.

With reference now to FIG. 4, a diagram of common raster operations is depicted in accordance with a preferred embodiment of the present invention. These raster operations in table 400 are examples of operations that may be performed by graphics engine 306. For simplicity, this table contains only those raster operations involving only source and destination images. Raster operations are typically defined as 256 different combinations of logical operations performed on the source, pattern, and destination images to produce a new destination image. Table 400 in FIG. 4 illustrates a partial list of these operations. Operations requiring knowledge of the current contents of the video memory to calculate the bit map for the next screen is of particular interest with respect to performance. For example, operation OR is an operation in which each pel from a source is logically ORred with a pel from a destination with the result being written to a destination bit map in video memory. The pels constructed by performing a logical OR operation on pels read from both the source bit map in system memory and the destination bit map in video memory. This transfer is an example of a transfer of information that requires a read and write on the I/O bus.

Figure 5:
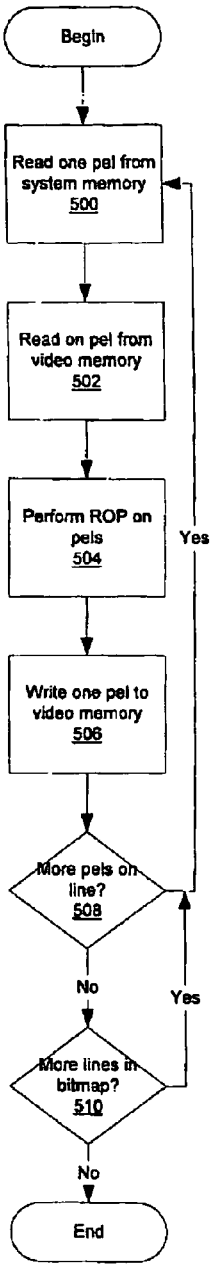
FIG. 5 is a flowchart of a known process for carrying out raster operations.

With reference now to FIG. 5, a flowchart of a known process for carrying out raster operations is illustrated. This known process begins by reading a pel from system memory (step 500). This pel is part of a source bit map located in the system memory. Thereafter, a single pel is read from video memory (step 502). This pel is part of a destination bit map located in the video memory. This step requires a read from the bus. These pels are typically stored in a register. Thereafter, a raster operation is performed on the pels (step 504).

Next, the pel is written to the video memory (step 506). This step requires a write across the bus to the video memory. Thereafter, a determination is made as to whether more pels are on the line for processing (step 508). If additional pels are present, the process then returns to step 500. Otherwise, a determination is made as to whether more lines are present in the bit map that is being processed by the raster operation (step 510). If more lines are present in the bit map, the process then returns to step 500 to process the next line one pel at a time. Otherwise, the process terminates. As can be seen in the process illustrated in FIG. 5, a change in direction of data on the data bus is required for each pel that is transferred. As a result, a turn around delay is incurred two times for each pel.

Figure 6:
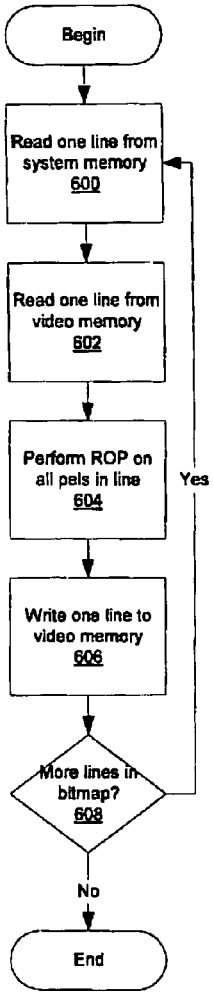
FIG. 6 is a flowchart of a process for performing a raster operation one scan line at a time, in which pels are written to video memory one scan line at a time, depicted in accordance with a preferred embodiment of the present invention.

With reference now to FIG. 6, a flowchart of a process for performing a raster operation is depicted in accordance with a preferred embodiment of the present invention. In this example, the processes of the present invention processes pels one scan line at a time.

In the depicted example, the process begins by reading a line from system memory (step 600). In the depicted example, this line is a scan line, which is read into a buffer in system memory. In this example, the scan line is part of a source bit map located on the system memory. Of course, other blocks of pels may be read from system memory depending on the implementation. Next, one line is read from video memory (step 602). This line is a scan line that is part of a destination bit map in the video memory associated with the video adapter. This particular step requires a transfer across the bus. Thereafter, a raster operation is performed on all of the pels in the line (step 604). In the depicted example, this raster operation may be a logical OR. This operation is performed on data stored within the system memory. Thereafter, the line is written to the video memory (step 606). This step requires a transfer in the opposite direction across the bus. Thereafter, a determination is made as to whether more scan lines are present in the bit map for processing. If additional scan lines are present, the process returns (step 600) to read a line from the system memory. Otherwise, the process terminates. As can be seen, this process reduces the number of bus delays by batching the accesses to the video memory as compared to the process illustrated in FIG. 5.

Figure 7:
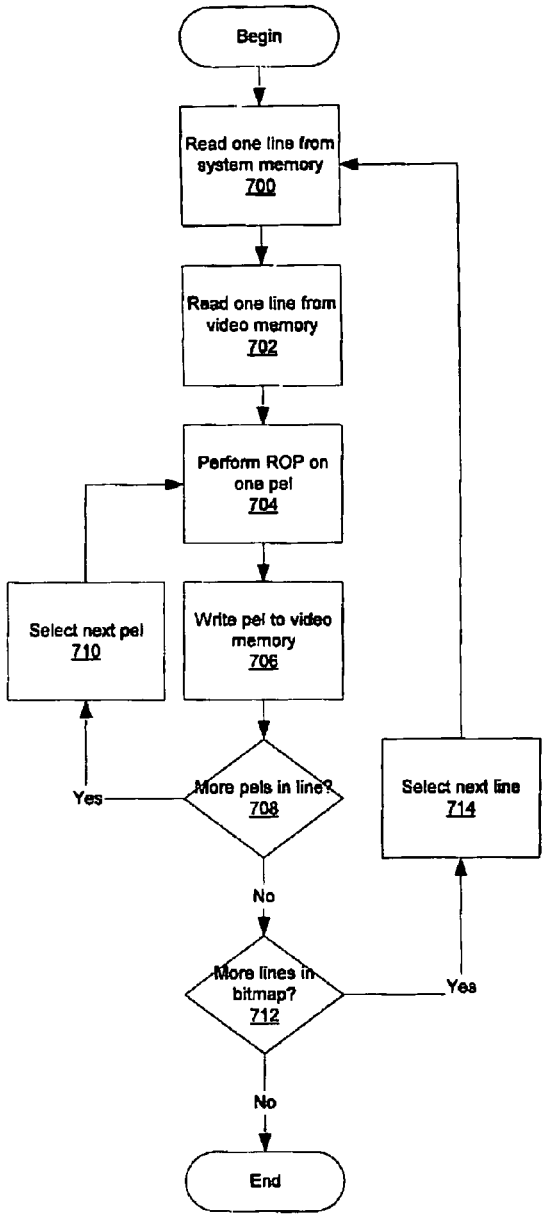
FIG. 7 is a flowchart of a process for performing raster operations one scan line at a time, in which pels are written to video memory one pel at a time, in accordance with a preferred embodiment of the present invention.

With reference now to FIG. 7, a flowchart of a process for performing raster operations is depicted in accordance with a preferred embodiment of the present invention. In FIG. 7, the processes illustrated reduce the number of changes in direction in the bus even though pels are individually written back to the video memory after being processed. FIG. 7 shows a process in which the writing of pels to video memory can be performed one pel at a time without performance degradation as long as reads are not interleaved with writes.

The process begins by reading one line from system memory (step 700). Thereafter, one line is read from video memory (step 702). Thereafter, a raster operation is performed on one pel (step 704). Thereafer, the resulting pel is written to video memory (step 706). A determination is then made as to whether more pels are present in the line (step 708). If more pels are present, then the next unprocessed pel is selected for processing (step 710), with the process then returning to step 704 as described above. Otherwise, a determination is made as to whether more lines are present in the bit map (step 712). If more lines are present, then the next unprocessed line is selected for processing (step 714), with the process then returning to step 700 to read that line from system memory. If additional lines are not present in the bit map for processing, the process then terminates. In this particular example, the raster operations are performed one pel at a time with each pel then being written back to the video memory. Performance hits, however, resulting from reads and writes are not incurred here as with the presently known processes. This lack of performance degradation occurs because an entire line of pels are written from the video memory over to the system memory for processing. The pels are then written back to the video memory one at a time, but a change in direction is not required for each raster operation.

Therefore, the present invention provides an improved method, apparatus, and instructions for performing raster operations, which avoid the severe performance problems experienced with the overhead of repeatedly switching the video bus from input to output and back. The present invention provides this advantage through video accesses being grouped into batches of entirely input or entirely output operations. As a result, the number of delays encountered by waiting for the bus to change directions is minimized. By batching the input and output on each line, video performance may be doubled. Although the example in FIG. 7 shows the batching of reads, the same mechanism may be performed for the batching of writes. The input operations and output operations may be collected into batches of input operations and output operations in which these operations are substantially equal to the number of rasters in a video display.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media such a floppy disc, a hard disk drive, a RAM, and CD-ROMs and transmission-type media such as digital and analog communications links.

The description of the present invention has been presented for purposes of illustration and description, but is not intended to be exhaustive or limited to the invention in the form disclosed. Many modifications and variations will be apparent to those of ordinary skill in the art. For example, although the depicted examples illustrate the processes being embodied within a graphics engine in a graphical subsystem, these process may be implemented in other locations in the operating system. For example, the processes also may be implemented within a device driver, such as video driver 308 in FIG. 3. The embodiment was chosen and described in order to best explain the principles of the invention, the practical application, and to enable others of ordinary skill in the art to understand the invention for various embodiment with various modifications as are suited to the particular use contemplated.

What is claimed is:

1. A method in a data processing system for performing a raster operation of graphics data, wherein the data processing system includes a system memory and a video memory, wherein the system memory and the video memory are connected by a bus and wherein the graphics data is organized into picture elements, the method comprising the data processing system implemented steps of:

selecting a first plurality of picture elements from the system memory;

selecting a second plurality of picture elements from the video memory, wherein the first plurality of picture elements and the second plurality of picture elements are selected such that changes in a direction of data on the bus are minimized when performing raster operations on the first plurality of picture elements and the second plurality of picture elements;

reading the first plurality of picture elements from the system memory;

reading the second plurality of picture elements from the video memory;

performing a raster operation on a picture element from the first plurality of picture elements and a picture element from the second plurality of picture elements to form a processed picture element;

writing the processed picture element to the video memory; and repeating the performing and writing steps for each picture element in the first plurality of picture elements and the second plurality of picture elements until all picture elements have been processed, wherein changes in the direction of data on the bus are minimized between the reading and writing of picture elements.

2. The method of claim 1, wherein the plurality of processed picture elements form a scan line.

3. The method of claim 1, wherein the raster operation performs a logic OR function using a picture element from the system memory and a picture element from the video memory.

4. The method of claim 1, wherein the first plurality of picture elements are part of a source bitmap.

5. The method of claim 1, wherein the second plurality of picture elements are part of a destination bitmap.

6. The method of claim 1, wherein the reading steps, the performing step, and the writing step are performed in a graphics engine.

7. A data processing system comprising:

a bus;

a system memory connected the bus, wherein a first plurality of graphics elements are located within the system memory;

a video memory connected to the bus, wherein a second plurality of graphics elements are located within the video memory;

a processor unit connected to the bus, wherein the processor unit executes instructions to select a first plurality of picture elements from the system memory; select a second plurality of picture elements from the video memory in which the first plurality of picture elements and the second plurality of picture elements are selected such that changes in a direction of data on the bus are minimized when performing raster operations on the first plurality of picture elements and the second plurality of picture elements; read the first plurality of picture elements from the system memory; read the second plurality of picture elements from the video memory; perform a raster operation on a picture element from the first plurality of picture elements and a picture element from the second plurality of picture elements to form a processed picture element; write the processed picture element to the video memory; and repeat performing and writing for each picture element in the first plurality of picture elements and the second plurality of picture elements until all picture elements have been processed, in which changes in the direction of data on the bus are minimized between the reading and writing of picture elements.

8. The data processing system of claim 7, wherein the first plurality of graphics elements is a plurality of picture elements.

9. The data processing system of claim 7, wherein the first plurality of graphics elements form a scan line.

10. The data processing system of claim 7, wherein the scan line is a scan line in a bitmap.

11. The data processing system of claim 7, wherein the first plurality of picture elements form a bitmap.

12. The data processing system of claim 7, wherein a graphics engine performs the raster operation.

13. The data processing system of claim 7, wherein a video driver performs the raster operation.

14. A data processing system for performing a raster operation of graphics data, wherein the data processing system includes a system memory and a video memory, wherein the system memory and the video memory are connected by a bus and wherein the graphics data is organized into picture elements, the data processing system comprising:

first selecting means for selecting a first plurality of picture elements from the system memory;

second selecting means for selecting a second plurality of picture elements from the video memory, wherein the first plurality of picture elements and the second plurality of picture elements are selected such that changes in a direction of data on the bus are minimized when performing raster operations on the first plurality of picture elements and the second plurality of picture elements;

reading means for reading the first plurality of picture elements from the system memory;

reading means for reading the second plurality of picture elements from the video memory;

performing means for performing a raster operation on a picture element in the first plurality of picture elements and a picture element in the second plurality of picture elements to form a processed picture element;

writing means for writing the plurality of processed picture elements to the video memory; and repeating initiate of the performing means and writing means for each picture element in the first plurality of picture elements and the second plurality of picture element until all picture elements have been processed, wherein changes in the direction of data on the bus are minimized between the reading and writing of picture elements.

15. The data processing system of claim 14, wherein the plurality of processed picture elements form a scan line.

16. The data processing system of claim 14, wherein the raster operation performs a logic OR function using a picture element from the system memory and a picture element from the video memory.

17. The data processing system of claim 14, wherein the first plurality of picture elements are part of a source bitmap.

18. The data processing system of claim 14, wherein the second plurality of picture elements are part of a destination bitmap.

19. The data processing system of claim 14, wherein the first reading means, the second reading means, the performing means, and the writing means are located in a graphics engine in the data processing system.

20. A computer program product in a computer readable medium for performing a raster operation of graphics data, wherein the data processing system includes a system memory and a video memory, wherein the system memory and the video memory are connected by a bus and wherein the graphics data is organized into picture elements, the computer program product comprising:

first instructions for selecting a first plurality of picture elements from the system memory;

second instructions for selecting a second plurality of picture elements from the video memory, wherein the first plurality of picture elements and the second plurality of picture elements are selected such that changes in a direction of data on the bus are minimized when performing raster operations on the first plurality of picture elements and the second plurality of picture elements;

third instructions for reading the first of a first plurality of picture elements from the system memory;

fourth instructions for reading the second plurality of picture elements from the video memory;

fifth instructions for performing a raster operation on a picture element in the first plurality of picture elements and a picture element in the second plurality of picture elements to form a processed picture element;

sixth instructions for writing the processed picture element to the video memory; and seventh instructions for initiating the fifth instructions and sixth instructions for each picture element in the first plurality of picture elements and the second plurality of picture elements until all picture elements have been processed, wherein changes in the direction of data on the bus are minimized between the reading and writing of picture elements.

* * * * *